US006633010B2

(12) United States Patent
Tanaka et al.

(10) Patent No.: US 6,633,010 B2
(45) Date of Patent: Oct. 14, 2003

(54) COMPACT, SEALED PRESSURE SWITCH

(75) Inventors: Shuji Tanaka, Susono (JP); Yoshihiko Mikawa, Gotenba (JP)

(73) Assignee: Texas Instruments Incorporated, Dallas, TX (US)

( * ) Notice: Subject to any disclaimer, the term of this patent is extended or adjusted under 35 U.S.C. 154(b) by 0 days.

(21) Appl. No.: 10/098,778

(22) Filed: Mar. 14, 2002

(65) Prior Publication Data

US 2002/0130022 A1 Sep. 19, 2002

(30) Foreign Application Priority Data

Mar. 19, 2001 (JP) ..... 2001-077538

(51) Int. Cl.[7] ..... H01H 35/26

(52) U.S. Cl. ..... 200/83 P; 200/81 R; 200/83 R; 200/83 A; 200/83 F; 200/83 J; 200/83 N

(58) Field of Search ..... 200/83 P, 81 R, 200/83 R, 83 A, 83 F, 83 J, 83 N

(56) References Cited

U.S. PATENT DOCUMENTS 4,939,321 A * 7/1990 Tanaka et al. ..... 200/83 P
5,004,876 A 4/1991 Sogge et al.
5,101,549 A 4/1992 Sogge et al.
5,278,367 A * 1/1994 Homol ..... 200/83 J
5,308,940 A 5/1994 O'Brien et al.
5,338,908 A 8/1994 Rahman et al.
5,508,483 A * 4/1996 Czarn et al. ..... 200/83 J
5,619,022 A * 4/1997 Long ..... 200/83 P

* cited by examiner

*Primary Examiner*—Elvin Enad
*Assistant Examiner*—Jennifer A. Poker
(74) *Attorney, Agent, or Firm*—Russell E. Baumann; Frederick J. Telecky, Jr.

(57) ABSTRACT

A pressure switch 1 of this invention comprises a base electrode 2, a terminal 3, a disc 4 and a diaphragm 5. The base electrode 2 has a switching chamber 7 for inserting the contact part 3*a* of the terminal 3. The switching chamber 7 is sealed with an insulation member at one side. The disc 4 is formed so as to be able to contact with the contact part 3*a* of the terminal while it is connected to the base electrode 2 and to be able to inverse under a predetermined magnitude of pressure. The diaphragm 5 is made of a metal and is fixed to the base electrode 2 so as to keep vacuum of the switching chamber 7 including the contact part 3*a* and the disc 4 by sealing the opening of the switch chamber 7 at other side.

6 Claims, 6 Drawing Sheets

FIG. 1
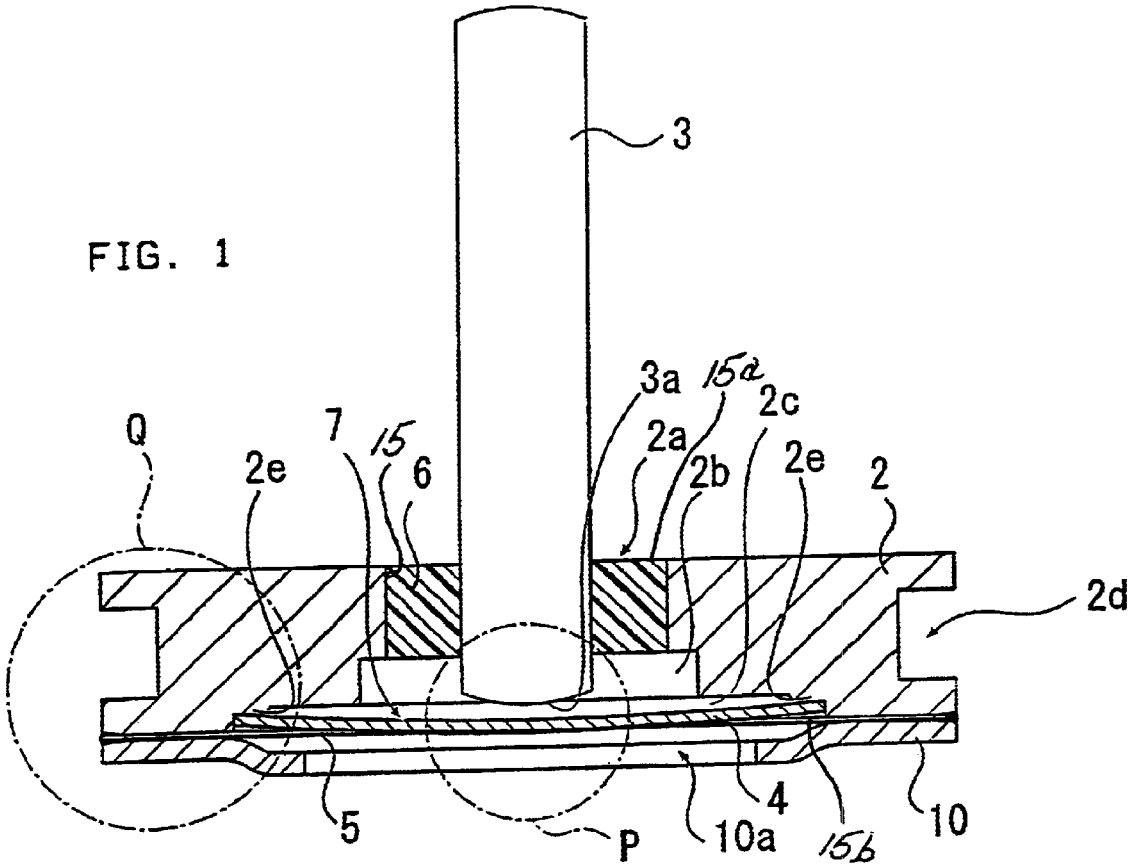
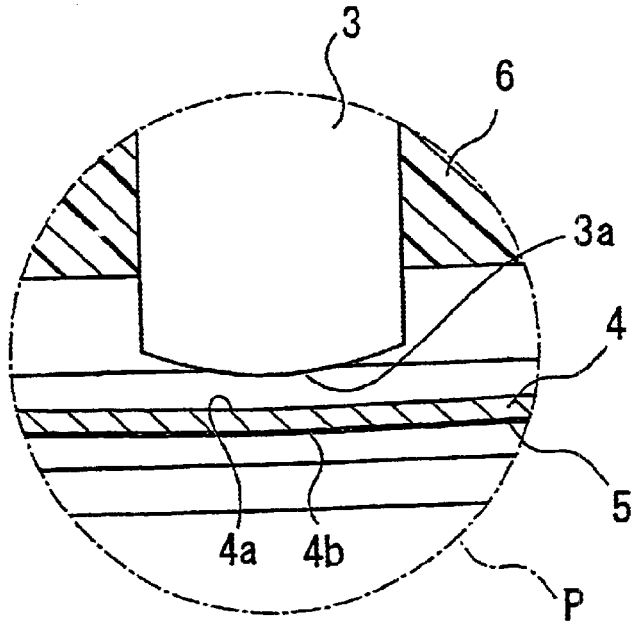
FIG. 2(a)

COMPACT, SEALED PRESSURE SWITCH

FIELD OF THE INVENTION

This invention relates to the field of pressure switches which may be used in the transmission of an automobile by way of example.

BACKGROUND OF THE INVENTION

It has been known to use pressure switches in the prior art which work with a controller to control various systems of an automobile such as the transmission mechanism. For example, a controller receives information from pressure switches as to whether the fluid pressure is of a prescribed level and with this information controls certain functions related to the operation of the automobile.

As is shown in FIG. 6, a prior art pressure switch 100 is provided with a switch chamber 103 that has been partitioned by a diaphragm 102 inside of a switch housing 101. A snap action disc member 104 is provided in switch chamber 103 which is connected to plus terminal 105 and which is movable in and out of engagement with a contact member 106 depending upon the pressure of the fluid exerted upon it. When the disc member 104 is in engagement with contact member 106, an electrical signal is transmitted to a controller through connection of negative electrical terminal 107.

In said pressure switch 100 moreover, an oil cavity 100 is provided in housing 101 to receive oil from oil passage 109 to exert pressure on diaphragm 102. An oil pan 108 surrounds switch 100 as reservoir for the transmission use. It is desirable to try to prevent contaminants in the oil such as dust, chips, etc., from entering switch chamber 103. One method is to make the entrance route of the oil from the oil passage 109 to chamber inside of housing 101 a complicated path, for example, a tortuous path flowing around resin cover 111 and gasket 112.

In regard to switch 100, however, there is a need to put switch chamber 103 in communication with oil pan 108 for the purpose of stabilizing the pressure between the two. As a consequence of this, there have been cases where oil enters the switch chamber 103. In such a case, an oil film is produced between snap acting disc 104 and contact terminal 106 with the result that operational characteristics of the switch can change with changes in the viscosity of the oil. That is, the snap action of disc 104 in making contact with terminal 106 will vary with changes in viscosity of the oil.

Accordingly, there are instances where pressure switch 100 cannot transmit a proper pressure signal based upon the oil pressure instantaneously to the controller, especially in low temperature conditions. In the case where pressure switch 100 is mounted on a plate 113 to be apart from oil pan 108, on the other hand, there are design considerations related to strength, dimensional accuracy etc., with a resultant rise in manufacturing costs, in connection with the installation of each switch 100 on plate 113 so as to prevent a possible leak of oil inside of the oil pan 108 onto plate 113 through switch chamber 103.

In short, there is a strong need to prevent the possible encroachment of oil into switch chamber 103 and to minimize the affect of temperature on switch signal accuracy. Further, there is a need for a compact switch that can be manufactured economically and reliably which has superior operational stability.

SUMMARY OF THE INVENTION

Accordingly, it is an object of the present invention to provide a fluid pressure responsive switch with a sealed switching chamber to prevent fluid and other debris from entering the switching chamber thereby providing for a highly reliable switch.

It is another object of the present invention to minimize the effects of temperature variation on the operational performance of the switch.

It is yet another object of the present invention to provide for a compact switch with a simple design which can be manufactured economically and reliably.

More specifically, a pressure switch according to the present invention comprises a base electrode which has a central through hole running therethrough, having a top opening and a bottom opening, a terminal member at least a part of which is containing in said through hole which is electrically insulated from the base electrode by a seal member completely sealing the top opening, a curved shaped fluid pressure responsive disc located in said central through hole adapted to snap over center between a first position in which said disc is not in engagement with the terminal member and a second position in which said disc is in engagement with the terminal member in response to being exposed to a fluid pressure of predetermined value, said disc being electrically connected to said base electrode, and a diaphragm member positioned adjacent said disc for transmitting said fluid pressure from an external source to said disc, said diaphragm being in sealing engagement with said base electrode to completely seal closed the bottom opening of said base electrode thereby providing for a sealed chamber in said base electrode.

In accordance with an embodiment of this invention, the switch chamber is sealed in a vacuum state.

Additional objects and features of the invention will be set forth in part in the description which follows and in part will be obvious from the description. The objects and advantages of the invention may be realized and attained by means of the instrumentalities, combinations and articles particularly pointed out in the appended claims.

BRIEF DESCRIPTION OF THE DRAWINGS

The following drawings in and constituted as part of the specification illustrate preferred embodiments of the invention and, together with the description, serve to explain the objects, advantages and principles of the invention. In the drawings:

FIG. 1 shows a partial cross sectional front view of a pressure switch made in accordance with a preferred embodiment of the present invention;

BRIEF DESCRIPTION OF PREFERRED EMBODIMENTS

Figure 2B:
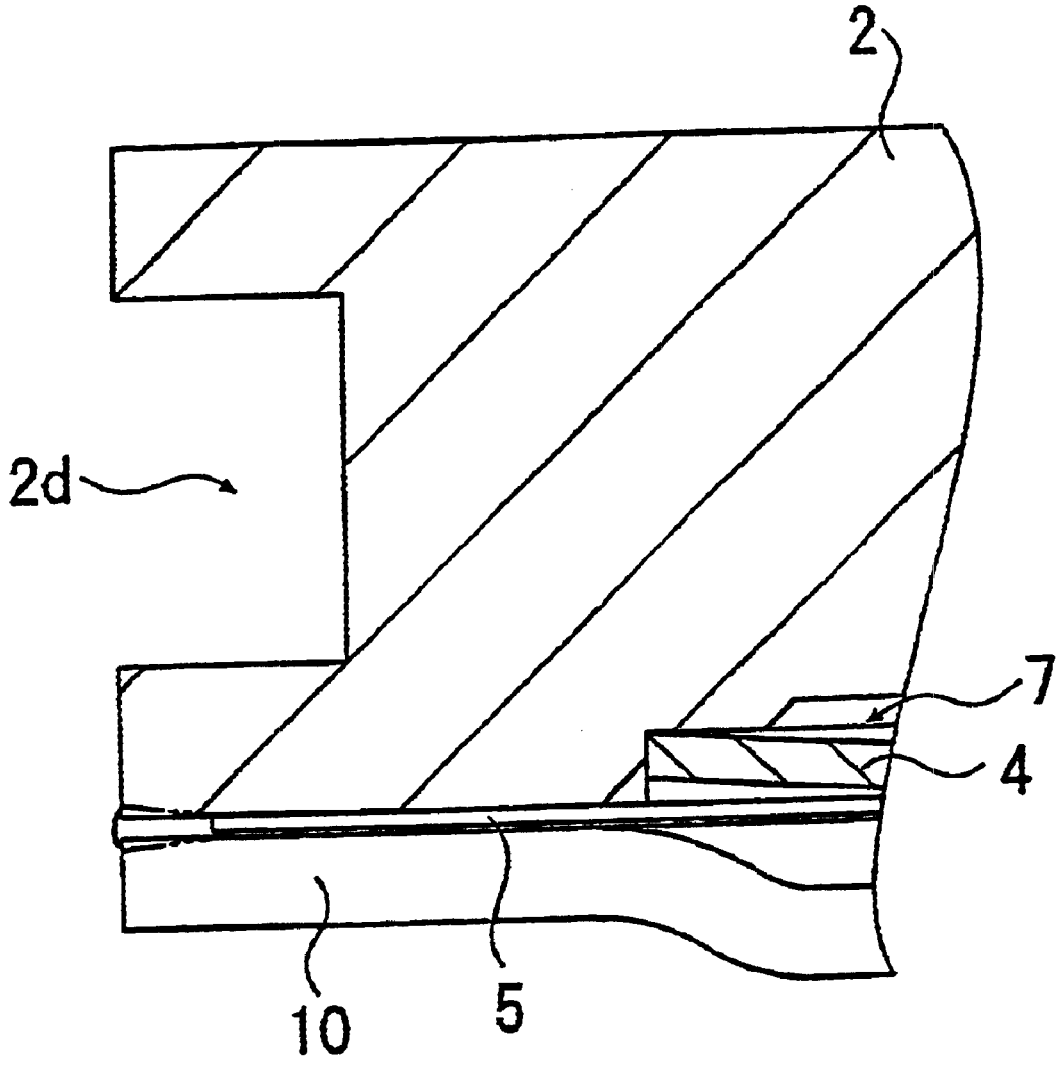
FIG. 2(*a*) shows the part P of FIG. 1 in an expanded view and FIG. 2(*b*) shows the part Q of FIG. 1 in an expanded view.

As is shown in FIG. 1, a pressure switch 1 according to this embodiment has a base electrode 2, a terminal 3, a disc 4 and a diaphragm 5.

Base electrode 2 is formed approximately in the shape of a cylinder preferably made out of metal such as stainless steel, for example. At the central part of base electrode 2, there is provided a central through hole 15 having a top opening 15*a* and bottom opening 15*b* with a plurality of different portions each having a different outer diameter with the smallest outer diameter at the top followed in succession with each portion having a larger diameter than the portion above it. That is, a sealing hole 2*a* has the smallest outer diameter followed by a central chamber 2*b* and then a disc chamber 2*c*. Moreover on the outer sidewall of base electrode 2 there is provided a groove 2*d* for receiving an O-ring (not shown).

Terminal 3 is formed in the shape of an elongated cylinder made out of metal such as a heat resistant stainless steel, for example. The outside diameter of terminal 3 is configured so as to be smaller in diameter than sealing hole 2*a*. At one end of terminal 3 there is provided a contact part 3*a* which is preferably gold plated to provide improved electrical contacting properties. Terminal 3 is fixed to base electrode 2 so as to be electrically insulated from it preferably by a glass sealing material 6 sealing close sealing hole 2*a*. Moreover, terminal 3 is positioned in such a manner that contact part 3*a* is generally situated in the center of central chamber 2*b* of base electrode 2 with the distal tip portion positioned to extend into the top portion of disc chamber 2*c*.

Disc 4 is formed with a curved shape out of a metal material such as stainless steel with its surface preferably being gold plated. The disc 4 is positioned to rest in contact with edge wall 2*e* of base electrode 2 in the assembled state. Further, in the assembled state, disc 4 has its top surface 4*a* of the curved concave shape spaced a predetermined distance from the tip end of contact 3*a* of terminal 3. In such a state, the bottom surface 4*b* of disc 4 may protrude somewhat from the lower surface of base electrode 2, as is shown in FIG. 2(*a*).

Diaphragm 5 is provided for sealing the bottom of disc chamber 2*c*. It is a thin sheet of material such as stainless steel or the like. The combination of glass seal 6 and diaphragm 5 seal off through hole 2 from the outside environment.

In this embodiment, it is desirable for diaphragm 5 to be made of the same metal material as that used for base electrode 2 to provide more reliable welding between the two components as described in more detail below. The size of diaphragm 5 is larger than the outside diameter of disc chamber 2*c* so as to completely cover the opening of chamber 2*c* while still being smaller than the outside diameter of base electrode 2.

In accordance with this invention, diaphragm 5 is preferably fixed onto base electrode 2 by welding. A preferred method of accomplishing such welding operation is to have it done in a vacuum chamber at a prescribed vacuum pressure (i.e., a pressure of less than 1000 Pa). In the vacuum chamber, disc 4 is installed inside of base electrode 2 being biased in place by diaphragm 5 which is sandwiched between base electrode 2 and a joining member 10.

In order to obtain uniform transfer of heat and a reliable weld, it is desirable that joining member 10 be made of the same metal as base electrode 2 and diaphragm 5.

Moreover, it is preferable that joining member 10 has the same size and shape as the bottom base electrode 2 so that at their periphery these items abut each other in a one to one relationship in the same plane to provide the weld area to join them together. There is a hole 10*a* provided at the center of joining member 10 to allow for the passage of pressurized oil to contact diaphragm 5. That is, joining member 10 resembles a washer shaped at its outer periphery to exactly align with the peripheral portion of the bottom of base electrode 2.

At this peripheral portion of base electrode and joining member 10, pressure and heat is applied to seam weld the two together along with a part of diaphragm 5 (peripheral part of diaphragm between peripheral portions of base electrode and joining member 10).

As a result of the vacuum welding of these three items together, central chamber 2*b* and disc chamber 2*c* form a switch chamber 7 which is sealed from the outside environment in a vacuum state.

In accordance with this embodiment, the pressure of the vacuum in switch chamber 7 should be generally between 100 Pa and 1000 Pa. If the pressure of the vacuum of switch chamber 7 is higher than 1000 Pa, there is a possibility of pressure shift due to variations in temperature.

In accordance with this invention, moreover, the actuation value as preselected for disc 4 will be set and due to the vacuum state in the switch chamber, such actuation value will not vary for defined operational parameters.

Figure 3:
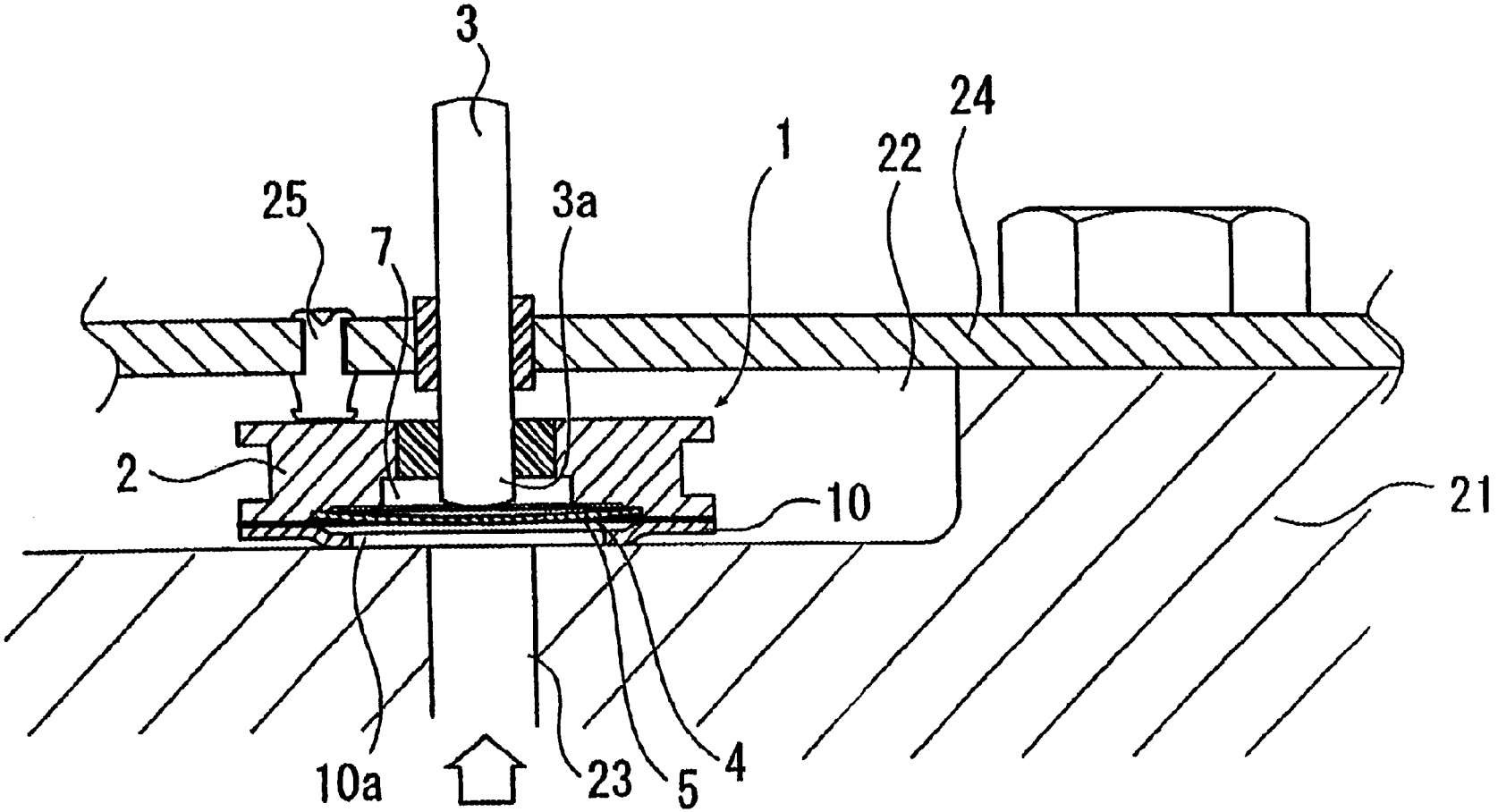
FIG. 3 shows the pressure switch of FIG. 1 mounted on a transmission.

FIG. 3 shows a pressure switch 1 of this invention for use with a transmission 21. Pressure switch 1 is typically one of a plurality of pressure switches associated with a manifold inside an oil pan 22 of multi-stage gear transmission 21. Pressured oil is received through inlet oil passageway 23 to exert a force against diaphragm 5 and then in turn snap acting disc 4. Upon the pressurized oil reaching a predetermined level, disc 4 will snap over center to make contact with contact part 3*a* of terminal 3. Terminal 3 is insulated from back-up plate 24 and oil pan 22 as one electrode. Base electrode 2 itself is electrically connected with connective terminal 25 so that a completed electrical circuit is provided from terminal 3 to connective terminal 25 when disc 4 is in contact with part 3*a* of terminal 3.

Even though it is not shown in the drawing, pressure switch is installed with an O-ring in the state where terminal 3 is insulated from back-up plate 24 and base electrode 2 is electrically connected to the back-up plate.

In the pressure switch of the present invention described above, dust or oil can not enter switch chamber 7 as switch chamber 7 is sealed by diaphragm 5 in a hermetic state even when pressure switch 1 is immersed in oil in oil pan 22. Since the switch chamber is maintained in the state of a vacuum, the vacuum pressure inside the switch chamber 7 is maintained at approximately a constant value even if the external temperature or the temperature of the oil surrounding it may change.

In operation when pressure switch 1 and more precisely diaphragm 5 is subjected to standard atmospheric pressure from the oil pan 22, disc 4 will not actuate (snap over center) and current will not flow between terminal 3 and connective terminal 25. However, when the gear mechanism of transmission 21 acts and the oil pressure supplied to diaphragm 5 reaches the predetermined pressure snap value for switch 1, disc 4 will snap over center to engage contact part 3*a* of terminal 3, with the result that the current passageway between terminal 3 and base electrode 2 and connective terminal 25 is closed.

In this state, the controller that controls transmission 21 obtains an electrical signal from pressure switch 1 through connective terminal 25 and back-up plate 24.

In accordance with this invention, switch chamber 7 of pressure switch 1 has a hermetic seal so that dust or oil may not enter the switch chamber. Accordingly, pressure switch 1 has high reliability, capable of transmitting a stabilized pressure signal value by preventing a contact failure, a delayed response or an erroneous pressure signal value, etc., that stems from foreign elements between the contacts.

In accordance with this invention, additionally, switch chamber 7 of pressure switch 1 is constructed to be in a predetermined high vacuum state. By being in this vacuum state, it becomes possible to obtain a pressure signal value which is highly reliable over a wide range of temperatures including low temperatures. That is, disc 4 actuation profile is not affected to any appreciable extent by being operated in an undesirable environment of changing temperatures due to switch chamber 7 being in a vacuum state.

In pressure switch 1, disc 4 can be calibrated to snap at a specific pressure only taking into account pressure value setting, without additionally having to allow for the affect of temperature change or the presence of oil in the switch chamber. On the other hand, prior art pressure switches had to take into account other physical parameters such as temperature change, oil film strength, etc., when calibrating to a specific pressure snap temperature, thereby not arriving at a totally accurate pure pressure setting.

In accordance with this invention, further, the base electrode serves generally as a housing for the switch and is electrically conductive with the electrode 3 insulated from it, thereby making it possible to use a switch design in which disc 4 is in direct electrical contact with base electrode 2. Accordingly, it becomes possible to make pressure switch 1 compact with a reduced member of parts thereby cutting down on the manufacturing cost.

Figure 4:
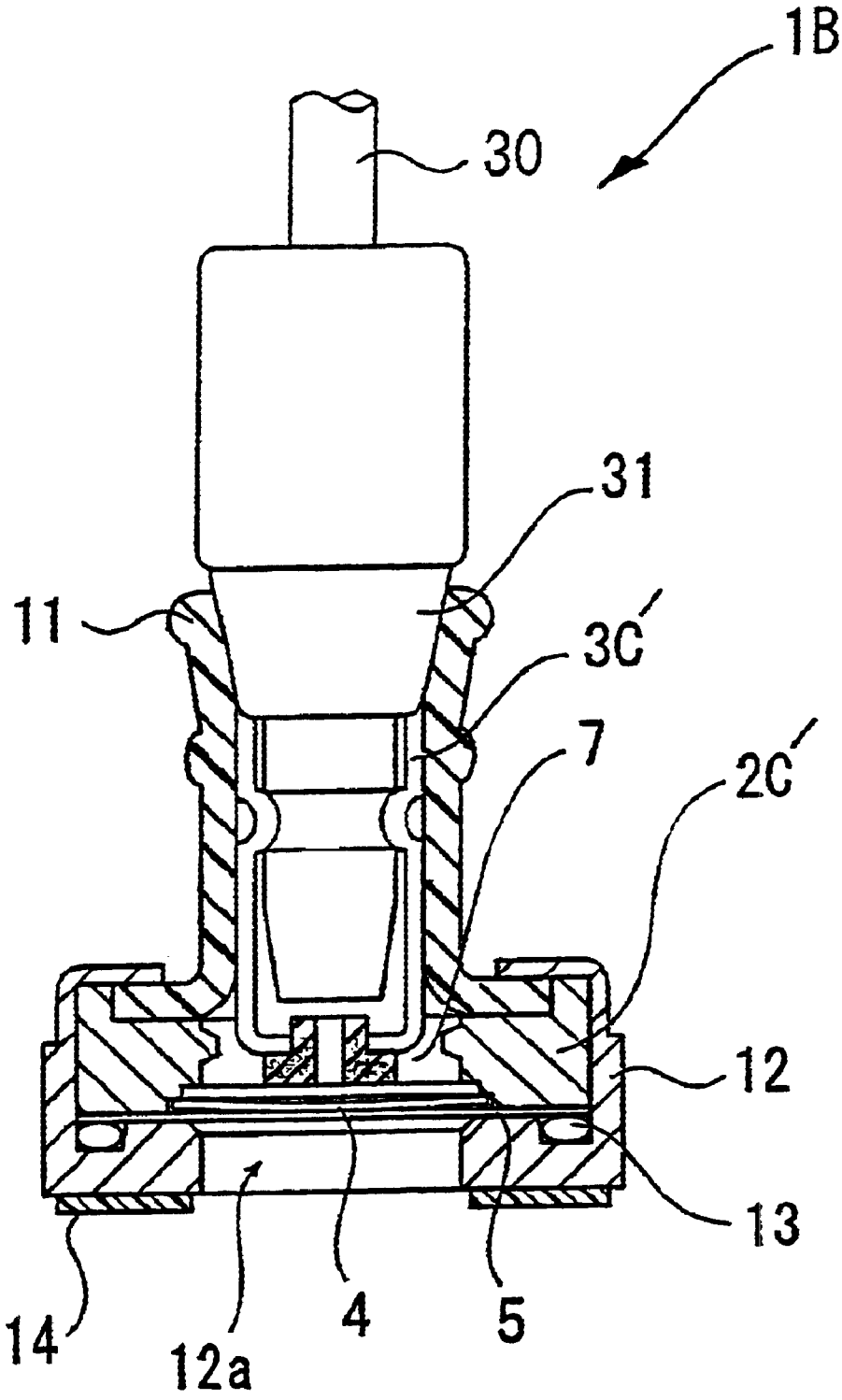
FIG. 4 shows a partial cross sectional view of a pressure switch made in accordance with a second embodiment of the present invention.

FIG. 4 shows a second embodiment of a switch according to the present invention. In this second embodiment, like numerals will be used to refer to like items as compared to the first embodiment.

As is shown in FIG. 4, this embodiment uses a modified contact 3*c*' that is engaged by disc 4 upon the disc being subjected to a predetermined pressure force. The switch chamber 7 formed by a base member 2*c*', contact 3*c*' and diaphragm 5 (not base electrode 2, glass seal 6 and diaphragm 5 as in the example above). Switch chamber 7 in this embodiment, however, is tightly sealed under atmospheric pressure as set forth below.

Pressure switch 1B is provided with a seal member 11 whose purpose is to tightly seal a connector member 31 of an electric wire 30 and contact 3*c*' to base 2*c*' with the help of a crimp member 12 to seal, seal member 11 to base 2*c*'. Seal member 11 is made of an electrically insulating flexible material such as a rubber, for example, and is sized to tightly adhere to contact 3*c*' with a top tip portion tightly adhered to connector 31. Connector 31 is physical and electrically connected to contact 3*c*'.

Seal member 12 is formed in the shape of a casing generally surrounding base member 2*c*' and diaphragm 5 at the bottom and has a circular groove near the outside portion of the bottom wall which accommodates an O-ring 13 and a central through hole 12*a* in the central portion of the bottom wall to provide a fluid passage for the pressurized oil to contact diaphragm 5. The distal end of the sidewall of seal member 12 is tightly crimped over base 2*c*' and seal member 11 while compressing O-ring 13 to sealingly secure together the various components of pressure switch 1*b*.

A gasket member 14 surrounds through hole 12*a* in contact with the bottom wall of seal member 12.

In accordance with this embodiment of the invention, there is provided a pressure switch with the various components of the switch tightly sealed together. Accordingly, this design shuts out dust, etc., from the switch chamber 7 without the need of the so-called "labyrinthine" structure of the prior art, thereby simplifying the structure of pressure switch 1B and reducing the manufacturing cost as well as the number of parts involved. The reliability of the device is also greatly improved.

Figure 5:
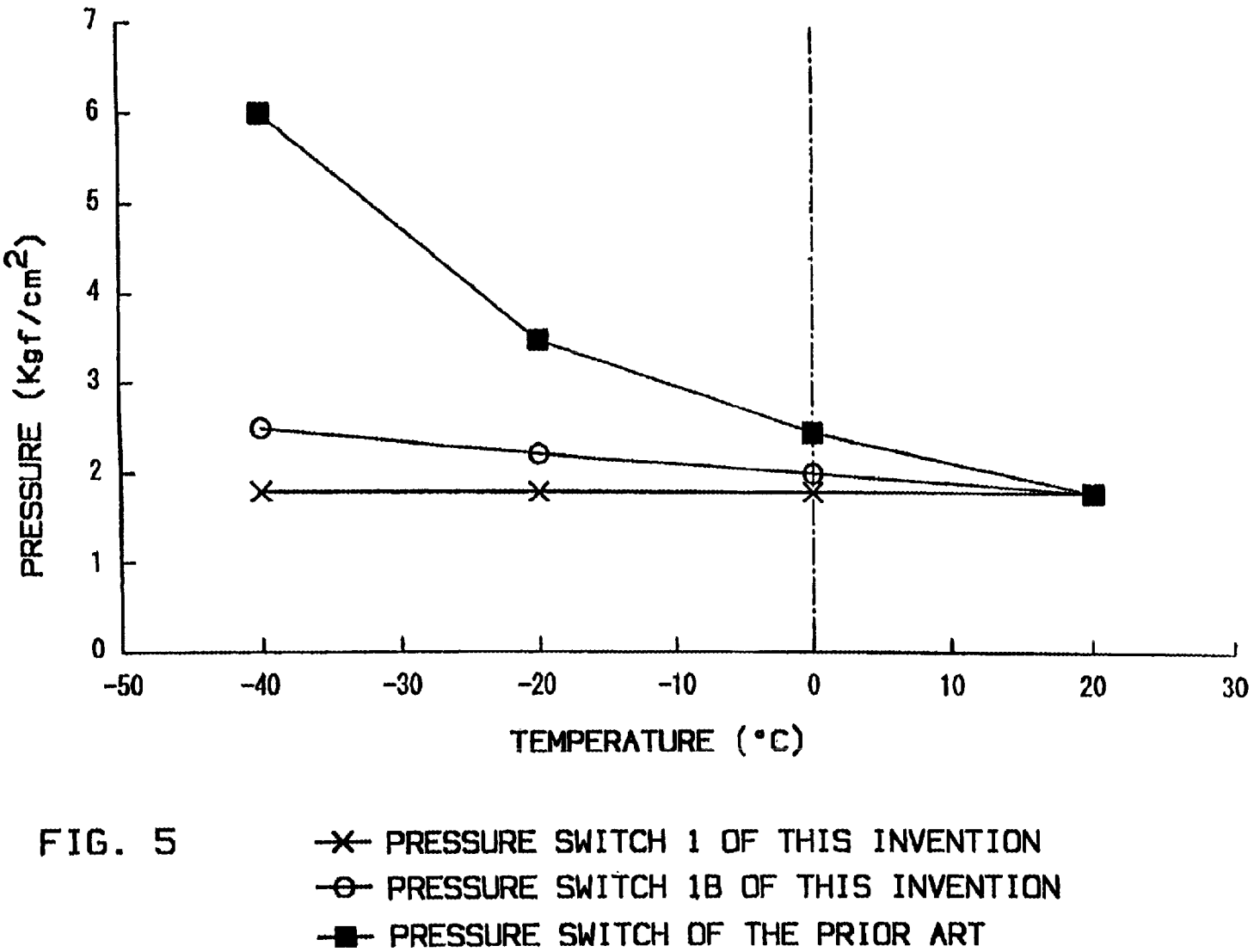
FIG. 5 shows a graph comparing operating characteristics between prior art pressure switch and switches of the present invention.
Figure 6:
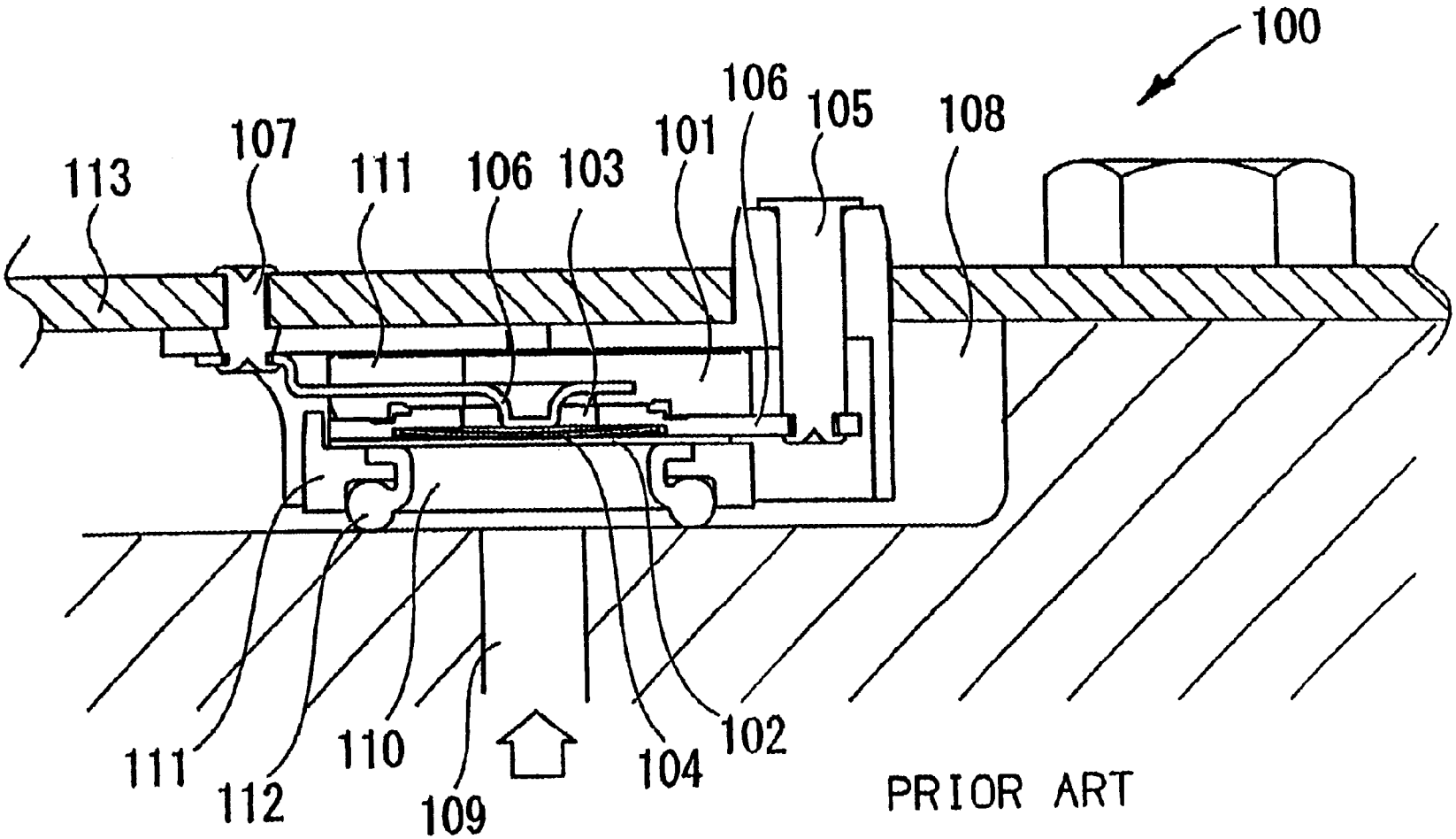
FIG. 6 shows a partial cross sectional front view of a pressure switch according to prior art.

FIG. 5 is a graph that shows the shift in snap value of snap acting disc 4 that takes place due to the changes in temperature for pressure switches according to this invention and prior art pressure switches.

The relation between the temperature variation of the oil in the transmission and the actual snap action value of the discs was measured by using a pressure switch according to the first embodiment of this invention, a pressure switch according to the second embodiment of this invention and a pressure switch according to prior art.

As shown in FIG. 5, the pressure switch according to the first embodiment of the present invention revealed the fact that the actual snap value of the disc remained constant irrespective of the temperature of the oil. The pressure switch according to the second embodiment of the present invention revealed the fact that the snap value of the disc becomes somewhat larger than the set value as the temperature of the oil becomes colder. The pressure switch according to a switch of the prior art revealed the fact that the snap value becomes substantially larger than the set value, especially at low temperatures where at minus 40 degrees C. the snap value was approximately three times the set value.

The results described above clearly show the advantages of the present claimed invention.

The forms of implementation of this invention have been explained above. It is obvious that the range of applicability of this invention is not restricted to those items which have been shown in the above embodiments.

What is claimed:

1. A pressure switch having a compact design comprising a base electrode which has a central through hole having a top opening and a bottom opening, a terminal member at least a part of which is contained in said through hole which is electrically insulated from the base electrode by a seal member completely sealing the top opening, a curved shaped fluid pressure responsive disc located in said central through hole adapted to snap over center between a first position in which said disc is not in engagement with the terminal member and a second position in which said disc is in engagement with the terminal member in response to being exposed to a fluid pressure of predetermined value, said disc being electrically connected to said base electrode, a diaphragm member positioned adjacent said disc for transmitting a fluid pressure from an external source to said disc, and a joining member positioned directly adjacent said diaphragm to work with said base electrode to sandwich said diaphragm between said joining member and said base electrode, said diaphragm being in sealing engagement with said base electrode and said joining member to completely seal closed the bottom opening thereby providing for a sealed chamber in said base electrode, said joining member, said diaphragm, and said base electrode all being made of a generally same metal.

2. A pressure switch according to claim 1 in which the sealing of said top opening and said bottom opening are hermetic with at least one of the seals done under vacuum thereby providing for said sealed chamber to be in a vacuum state.

3. A pressure switch according to claim 2 wherein said seal of said bottom opening is done by welding.

4. A pressure switch according to claim 2 wherein said seal of said top opening is done by glass sealing.

5. A pressure switch according to claim 2 wherein said vacuum state is between 100 Pa and 1000 Pa.

6. A pressure switch according to claim 1 further including an additional terminal in electrical communication with said base electrode.

* * * * *